33-260 SR
10/17/78 XR 4,120,096

United States Patent [19]
Keller

[11] 4,120,096
[45] Oct. 17, 1978

[54] BOW SIGHT

[76] Inventor: Charles R. Keller, 411 Old Evans Rd., Martinez, Ga. 30907

[21] Appl. No.: 805,743

[22] Filed: Jun. 13, 1977

[51] Int. Cl.² ..... F41G 1/02
[52] U.S. Cl. ..... 33/265; 33/260; 33/283; 33/292
[58] Field of Search ..... 33/265, 260, 273, 283, 33/282, 290, 259

[56] References Cited

U.S. PATENT DOCUMENTS

| | | | |
|---|---|---|---|
| 51,675 | 12/1865 | Abbott | 33/273 |
| 533,003 | 1/1895 | Dieffenbach | 33/260 |
| 937,244 | 10/1909 | Kennedy | 33/260 |
| 2,925,656 | 2/1960 | Genovese | 33/265 |
| 3,013,336 | 12/1961 | Pennington | 33/265 |
| 3,212,190 | 10/1965 | Larson | 33/265 |

FOREIGN PATENT DOCUMENTS

| | | | |
|---|---|---|---|
| 527,783 | 12/1956 | Belgium | 33/283 |

*Primary Examiner*—William D. Martin, Jr.
*Attorney, Agent, or Firm*—Bailey, Dority & Flint

[57] ABSTRACT

A sight for use on a bow for aiding an archer in sighting on a target from both elevated and level shooting positions. The sight includes an elongated sighting element which has a plurality of sighting beads thereon. The elongated sighting element is pivotably mounted on a horizontally extending shaft and is balanced so that the top bead on the elongated sighting element pivots about said horizontal shaft as the bow is tilted for automatically determining the proper elevation of the bow when shooting from an elevated position. The elongated sighting element may be locked in various arcuate positions when shooting on the ground.

4 Claims, 5 Drawing Figures

BOW SIGHT

BACKGROUND OF THE INVENTION

The present invention relates to a bow sight and, more particularly, to a bow sight which automatically determines the proper elevation of the bow when shooting from an elevated position and is also capable of being used when shooting from the level ground position.

Bow sights are well known for aiding in calculating the proper trajectory for an arrow when being shot by an archer. One example of a bow sight that aids in calculating the range for an archer is disclosed in U.S. Pat. No. 2,788,701. The device illustrated in this patent is alleged to automatically determine the proper elevation of the bow when shooting at a selected target.

Another automatic sight for an archer's bow is illustrated in U.S. Pat. No. 3,013,336. The device disclosed therein will enable an archer to accurately determine the degree which he has tipped the bow to secure a desired curve of trajectory. Thus, after the desired degree of tip necessary to secure the necessary elevation to reach a target has once been determined by trial and error, the archer may thereafter duplicate at will the degree of elevation and thus make more certain the accuracy of his shots.

Examples of other types of archery sights are illustrated in U.S. Pat. Nos. 2,542,501, 3,212,190, 3,925,656, and 3,058,221.

SUMMARY OF THE INVENTION

The bow sight constructed in accordance with the present invention is primarily designed to help a bow hunter to shoot an arrow accurately from an elevated position such as a tree stand while hunting animals such as deer. The bow sight can also be used on the ground similar to the sights commonly referred to as a fixed pin sight.

The sight includes a substantially oval-shaped housing which has laterally spaced side walls with an open front and rear. A horizontally extending shaft is journaled between the sidewalls of the oval-shaped housing. An elongated sighting element which has a plurality of spaced beads positioned thereon is carried on said horizontal shaft. The elongated sighting element is balanced so that the beads pivot about the horizontally extending shaft as the bow is tilted when shooting from an elevated position for automatically determining the proper elevation of the bow. The housing has sufficient depth to enclose at least the front end of the elongated sighting element so that it cannot be damaged by limbs and trees when in use.

When it is desired to use the sight on the ground, the elongated sighting element is locked in a fixed position which is normally a vertical position.

If, after calibrating the proper tilt for the bow to strike a target at a predetermined distance, the archer may unlock the sighting element and adjust it arcuately so that when shooting the bow, the top bead is utilized.

Accordingly, it is an important object of the present invention to provide a bow sight which can be utilized both from elevated as well as level positions.

Another important object of the present invention is to provide a bow sight which automatically determines the proper elevation of a bow when shooting from an elevated position.

Still another important object of the present invention is to provide a relatively simple and accurate bow sight that can be readily mounted on the sight of a bow.

These and other objects and advantages of the invention will become apparent upon reference to the following specification, attendant claims, and drawing.

BRIEF DESCRIPTION OF THE DRAWING

FIG. 1 is a perspective view illustrating an archer standing on an elevated tree stand in a position normally taken when shooting deer and the like.

DESCRIPTION OF A PREFERRED EMBODIMENT

Figure 1:
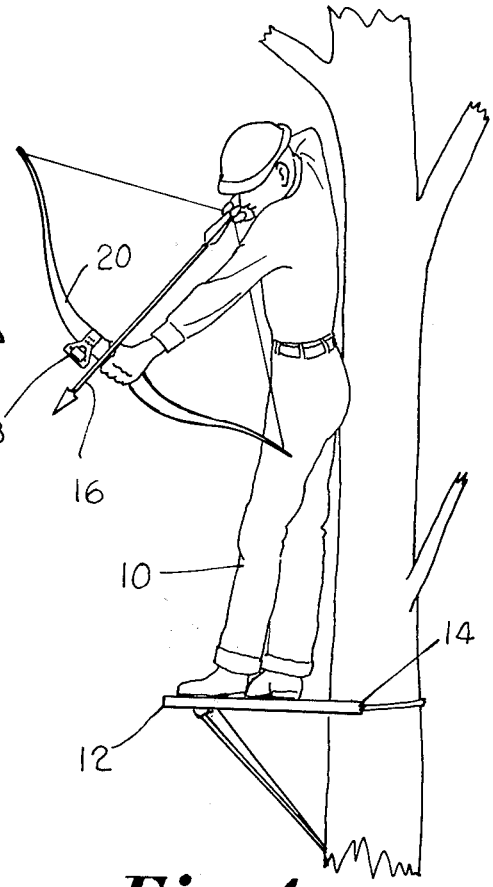

Referring in more detail to FIG. 1, there is illustrated an archer 10 standing on an elevated platform 12 which is mounted in a tree 14. The archer is illustrated as aligning an arrow 16 utilizing a bow sight 18 mounted on the side of a bow. This is the normal position that the archer takes when shooting deer passing below the tree. The bow sight is mounted on the side of the bow 20 by means of a bracket 22. Bolts 24 extend through holes provided in the bracket for being threaded into threaded holes provided in the side wall of the bow 20. Adjacent the front of the bracket is an inwardly turned flange 26. The bracket has a vertically extending elongated slot 28 provided in the body thereof to which a sight generally designated by reference character 30 is secured by means of bolts 32 and 34. The bolts 32 and 34 are threaded and extend through the slot 28 and are secured to the bracket by means of a wing nut 36 which is positioned on one side of the bracket and a nut 38 which is positioned on the other side of the bracket. The sighting element 30 may be adjusted vertically relative to the bracket by merely loosening the wing nuts 36.

The pivotal sight is carried within a protective oval-shaped housing which has laterally spaced side walls 42 and 44. Side wall 44 is welded to the inner ends of the bolts 32 and 34. An elongated horizontally extending shaft 46 is journaled between the side walls 42 and 44 for permitting rotation therebetween. The ends of the shaft 46 are journaled in recesses provided in the inner end of screws 48 which are, in turn, threaded in the side walls 42 and 48.

Figure 2:
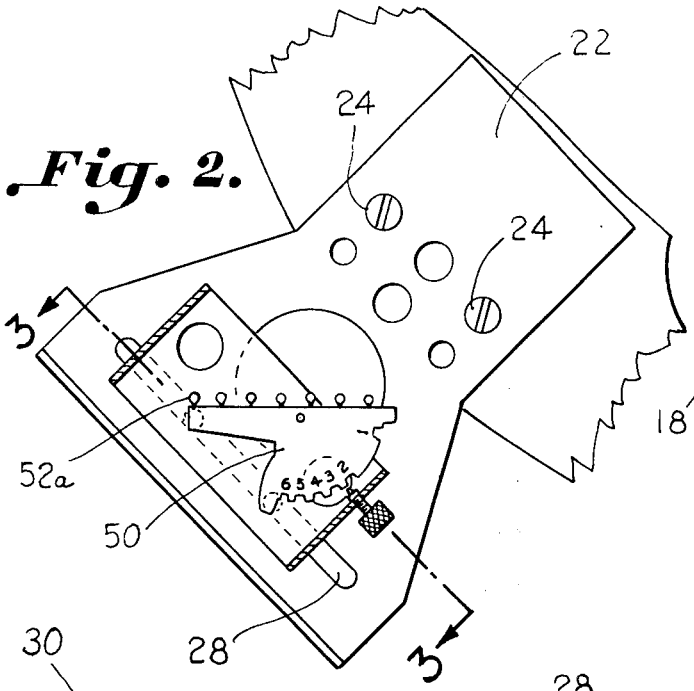
FIG. 2 is an enlarged side elevational view illustrating the position of the bow sight when an archer is shooting at an angle such as in FIG. 1.
Figure 4:
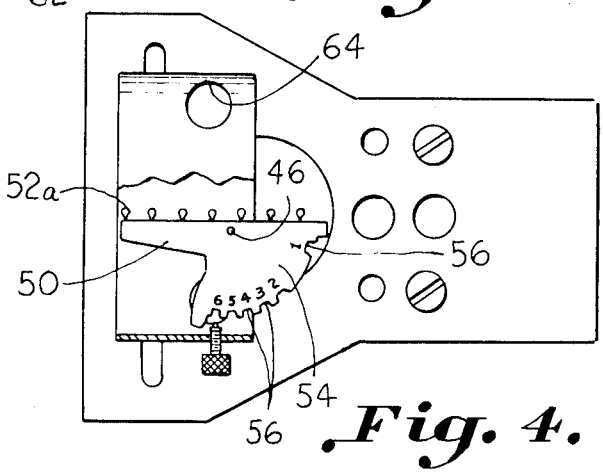
FIG. 4 is an enlarged elevational view illustrating the position of the sighting element when shooting horizontally with the sight unlocked.

An elongated sighting element 50 is supported on the horizontal shaft 48 and is fixed thereto by welding so as to rotate with the shaft 46. The sighting element 50 has a plurality of beads **52*a* through 52*g* spaced on a substantially straight surface. The sighting element 50 is balanced so that when the bow is held in a vertical position, the elongated sighting element 50 will assume a horizontal position such as illustrated in FIG. 4. As the bow is tilted forward, the sighting element 50 and shaft 46 rotate relative to the bracket remaining in the horizontal position such as illustrated in FIG. 2. This enables an archer, when standing on an elevated platform such as illustrated in FIG. 1, to sight on an object passing therebelow. He would normally use the top bead 52***a* when sighting on this object.

The elongated sighting element 50 has an arcuate portion 54 in which slots 56 are provided. These slots are numbered 1 through 6 by stamping numbers adjacent thereto. The sighting element is balanced so that when it is in the unlocked position such as illustrated in FIGS. 2 and 4, the line of beads 52*a* through 52*g* will remain in a horizontal plane regardless of the tilt of the bow.

A threaded locking pin 58 extends through the bottom of the housing and has a tip 60 provided therein which is adapted to fit within one of the slots 56. When the knurled head 62 of the screw 58 is rotated clockwise, the tip 60 is inserted into a slot for locking the sighting element.

Figure 3:
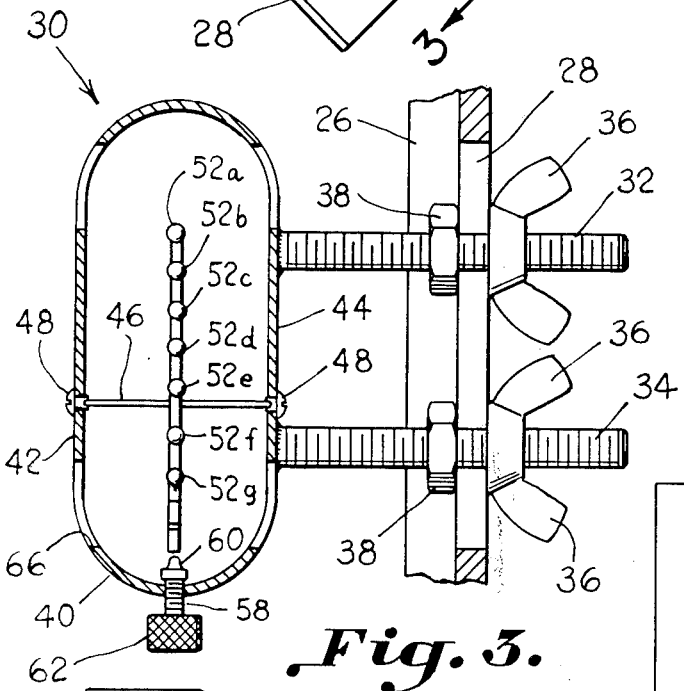
FIG. 3 is a sectional view taken along line 3—3 of FIG. 1.
Figure 5:
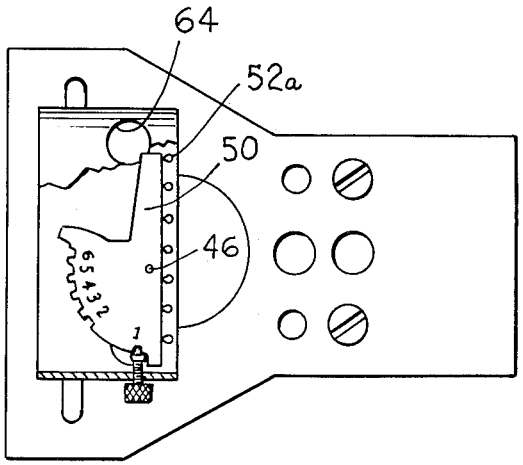
FIG. 5 is an enlarged side elevational view illustrating an elongated sighting element locked in a vertical position.

As illustrated in FIGS. 3 and 5, the sighting element is locked in the vertical position. This is the normal position that the sighting element is locked into when the archer is shooting on the ground. If, after calibrating the bow for a predetermined distance, it is found that instead of sighting off of the top bead 52*a* it is best to sight off the third bead 52*c*, for example, to obtain the desired trajectory, then the locking mechanism can be loosened and the sight pivoted so that the bead 52*a* will be in the position where bead 52*c* was in calibrating the bow. Each of the slots 56 labeled 1 through 6 in effect permit the top bead to be dropped the equivalent of the spacing between one bead. In other words, if it is desired to lower the bead 52*a* as shown in FIG. 3 to the position of 52*b*, then the locking pin will be inserted in slot 2. If it is desired to lower the bead 52*a* as shown in FIG. 3 to the position in which bead 52*d* is located, then the locking pin would be placed in the slot 4. The purpose of this is to permit the archer to always sight off of the top bead when shooting. After the archer has shot or calibrated his bow on the ground, he can then return to the tree and by merely releasing the locking screw 62, the sighting device swings freely and automatically determines the proper tilt or elevation of the bow for shooting the arrow. Normally, the sighting device is accurate from adjacent the base of the tree to approximately 30 yards outward from the tree. Depending on the height of the tree stand, when the target is approximately 30 yards out from the tree, the beads or sighting device 50 will assume the position such as illustrated in FIG. 4.

The purpose of the holes 64 provided in the top of the housing 40 are to allow light to pass into the housing for better vision of the sighting beads. The holes 66 provided adjacent the bottom of the housing allows the archer to better view the numbers carried on the sighting element 50.

As can be seen, the archer can readily use the sighting element on the ground by merely locking the sighting element with the screw into the position illustrated in FIG. 5 or he can use the same sighting element for sighting targets from an elevated position such as illustrated in FIG. 1 by merely allowing gravity to maintain the balance sighting element 50 in the horizontal position regardless of the downward tilt of the bow.

While a preferred embodiment of the invention has been described using specific terms, such description is for illustrative purposes only, and it is to be understood that changes and variations may be made without departing from the spirit or scope of the following claims.

What is claimed is:

1. A sight for use on a bow for aiding an archer in sighting on a target from both an elevated and level shooting position, said sight comprising:

an elongated sighting element having at least one sighting bead thereon, means for pivotally mounting said elongated extending sighting element on a horizontal axis, said sighting element being balanced about said horizontal axis so that said bead pivots about said horizontal axis as said bow is tilted for automatically determining the proper elevation of said bow when shooting from an elevated position, said elongated sighting element including:

(i) an arcuate surface adjacent a bottom portion thereof, (ii) a plurality of slots spaced about said arcuate surface, and means for inserting a locking element in one of said slots for locking said elongated sighting element in a predetermined position about said horizontal axis.

2. The sight as set forth in claim 1 further comprising:

a housing surrounding said elongated sighting element, said housing including a pair of laterally spaced vertically extending side walls, said means for pivotably mounting said elongated extending sighting element includes:

(i) a horizontally extending shaft supporting said elongated sighting element, and (ii) means for journaling said horizontally extending shaft between said laterally spaced vertically extending side walls so that said elongated sighting element can pivot therewith.

3. A sight for use on a bow for aiding an archer in sighting on a target from both an elevated and level shooting position, said sight comprising:

a substantially oval-shaped housing having laterally spaced side walls with an opened front and rear, a horizontally extending shaft, means for journaling said horizontally extending shaft between said laterally spaced side walls, an elongated sighting element having at least one sighting bead thereon carried on said shaft, said elongated sighting element being balanced so that said bead pivots about said horizontally extending shaft as said bow is tilted for automatically determining the proper elevation of said bow when shooting from an elevated position, said housing having sufficient depth to enclose at least said top portion of said elongated sighting element as it pivots from a vertical to a horizontal position, and means for locking said elongated sighting element in a vertical position when shooting from a level position.

4. A sight for use on a bow for aiding an archer in sighting on a target from both an elevated and level shooting position, said sight comprising:

an elongated sighting element having at least one sighting bead thereon, means for pivotably mounting said elongated extending sighting element on a horizontal axis, said sighting element being balanced about said horizontal axis so that said bead pivots about said horizontal axis as said bow is tilted for automatically determining the proper elevation of said bow when shooting from an elevated position, a plurality of sighting beads are spaced along said elongated sighting element, and means for selectively locking said elongated sighting element at different angular positions about said horizontal axis for adjusting the elevation of a particular sighting bead in order to aid in maintaining said bow at the proper tilt while shooting.

* * * * *